US006607153B1

(12) United States Patent
Gingras

(10) Patent No.: US 6,607,153 B1
(45) Date of Patent: Aug. 19, 2003

(54) REFINER PLATE STEAM MANAGEMENT SYSTEM

(75) Inventor: Luc Gingras, Lake Oswego, OR (US)

(73) Assignee: Durametal Corporation, Tualatin, OR (US)

( * ) Notice: Subject to any disclaimer, the term of this patent is extended or adjusted under 35 U.S.C. 154(b) by 0 days.

(21) Appl. No.: 09/720,896

(22) PCT Filed: Aug. 19, 1998

(86) PCT No.: PCT/US98/17184

§ 371 (c)(1),
(2), (4) Date: Jan. 2, 2001

(87) PCT Pub. No.: WO00/10710

PCT Pub. Date: Mar. 2, 2000

(51) Int. Cl.[7] ..... B02C 7/12

(52) U.S. Cl. ..... 241/261.3; 241/261.2; 241/298

(58) Field of Search ..... 241/261.2, 261.3, 241/298

(56) References Cited

U.S. PATENT DOCUMENTS 4,039,154 A * 8/1977 Peterson ..... 241/261.3
4,472,241 A * 9/1984 Provost ..... 162/28
5,181,664 A * 1/1993 Kohler ..... 241/261.3
5,383,617 A * 1/1995 Deuchars ..... 241/298
5,476,228 A * 12/1995 Underberg ..... 241/296
5,492,548 A * 2/1996 Wasikowski ..... 51/293
5,823,453 A * 10/1998 Garasimowicz ..... 241/261.3
5,893,525 A * 4/1999 Gingras ..... 241/298
5,975,438 A * 11/1999 Garasimowicz ..... 241/15
5,988,538 A * 11/1999 Bartels ..... 241/28
6,032,888 A * 3/2000 Deuchars ..... 241/261.3
6,314,381 B1 * 11/2001 Johansson ..... 702/104
6,325,308 B1 * 12/2001 Lofgren et al. ..... 241/28
6,402,071 B1 * 6/2002 Gingras ..... 241/261.2

* cited by examiner

*Primary Examiner*—William Hong
(74) *Attorney, Agent, or Firm*—Alix, Yale & Ristas, LLP

(57) ABSTRACT

A refiner plate for the face of a refiner disc comprising a plurality of refiner segments arranged side-by-side on the face of the disc to form a substantially annular refining region. Each refiner segment has a plurality bars and grooves for refining a lignocellulosic material and forming a path for receiving and transmitting steam generated during the refining process. A plurality of dams are disposed within the grooves to retard the movement of the lignocellulosic material. A partial height portion of each dam adjacent the trailing face of the bar provides a flow path for the steam.

14 Claims, 4 Drawing Sheets

REFINER PLATE STEAM MANAGEMENT SYSTEM

CROSS-REFERENCE TO RELATED APPLICATIONS

This is the national state of International Application No. PCT/US98/17184 filed Aug. 19, 1998.

BACKGROUND OF THE INVENTION

The present invention relates generally to disc refiners for lignocellulosic material. More particularly, the present invention relates to refiner plate segments for such an apparatus.

In high consistency mechanical pulp refiners, the wood fibers are worked between two relatively rotating discs on which refiner plates are mounted. The plates usually have radial bars and grooves. A large volume of steam is produced between the plates as a result of this retained between the plates on the bar surfaces despite the high velocity of the flowing steam, and the enormous centrifugal forces. Typically, the steam is exhausted via the grooves. Dams which extend to the bar surface are provided in the grooves to interrupt material flow and thus improve the retention time of the material in the refining region.

In a typical refiner plate with radial bars and grooves, the bars provide impacts or pressure pulses which separate and fibrillate the fibers. The grooves enable radially directed feeding of the fibers and steam extraction. Near the perimeter of the plates, high radial steam flow and high centrifugal force both act to sweep the fibers outwardly from between the plates prematurely, thus reducing the refining effectiveness. The flow restrictions due to a small gap between opposed plates and fiber-filled grooves result in a steam pressure peak between the plates, located radially inward from the perimeter. This pressure peak is a major source of the refining thrust load, and can induce control instability at high motor loads. It is thus desirable that the steam generated during refining be discharged from the refining region as quickly as possible, while retaining the pulp within the region as long as possible.

Although the surface dams promote better and more homogeneous refining and help develop the pulp pad between the segments, they restrict the flow of steam in the grooves. Reduced steam flow results in higher pressure peaks, creating a greater thrust load and more instability.

SUMMARY OF THE INVENTION

Briefly stated, the invention is a refiner plate segment for refining lignocellulosic material. The refiner plate segment has a refining zone comprising a plurality of alternating, substantially radially disposed bars and grooves. Each of the bars has a top grinding surface, a leading surface and a trailing surface. At least one dam extends radially across a groove intermediate the leading bar and the trailing bar of a bar pair. The dam comprises a first portion extending from the trailing surface of the leading bar and a second portion extending from the leading surface of the trailing bar. Each of the portions of the dam have a top surface, where the top surface of the second portion is substantially co-planar with the top surface of the bars and the top surface of the first portion is disposed intermediate the top surface of the bars and the base of the groove.

Preferably, a plurality of the dams are disposed in each of the grooves. In one embodiment, the trailing surface and the top surface of the leading bar define a cavity disposed adjacent the first portion of the dam. The cavity creates an arcuate shaped segment in the trailing face of the leading bar and has a bottom which is substantially co-planar with the top surface of the first portion of the dam to reduce the possibility of inducing turbulence in the flow of material.

It is an object of the present invention to provide a refiner plate for the face of a refiner disc, which facilitates the removal of steam while retaining the pulp in the refiner region to achieve satisfactory pulp quality.

It is also an object of the present invention to provide a refiner plate for the face of a refiner disc, which directs the material to be refined onto the refining surfaces of the disc.

Other objects and advantages of the invention will become apparent from the drawings and specification.

BRIEF DESCRIPTION OF THE DRAWINGS

The present invention may be better understood and its numerous objects and advantages will become apparent to those skilled in the art by reference to the accompanying drawings in which.

DETAILED DESCRIPTION OF THE PREFERRED EMBODIMENT

Figure 3:
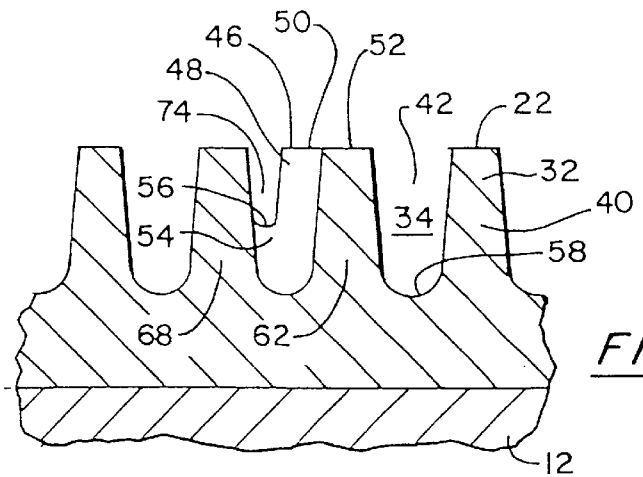
FIG. 3 is an enlarged section view along line 3—3 of FIG. 1.

With reference to the drawings wherein like numerals represent like parts throughout the several figures, a refiner plate having a steam management system in accordance with the present invention comprises a plurality of refiner plate segments 10 which are securable to the front face of a substantially circular refiner disc 12 (FIG. 3). Although in the illustrated embodiment each segment 10 has two zones 14, 16 each having a differently oriented set of patterns, each segment 10 could alternatively have a single, three or more zones having respective sets of patterns (FIG. 1).

The plate segments 10 are attached to the disc face, in any convenient or conventional manner, such as by bolts (not shown) passing through bores 18. One end of the bolt engages the disc and at the other end has head structure bearing against a countersunk surface 20. The disc 12, only a portion of which is shown, has a center about which the disc rotates, and a substantially circular periphery. The refiner plate segments 10 are arranged side-by-side on the face of the disc 12, to form a substantially annular refiner face 22, shown generally at (FIG. 3). The refiner face 22 forms a portion of a refiner region, when confronting another refiner plate (not shown) carried by another disc.

Figure 1:
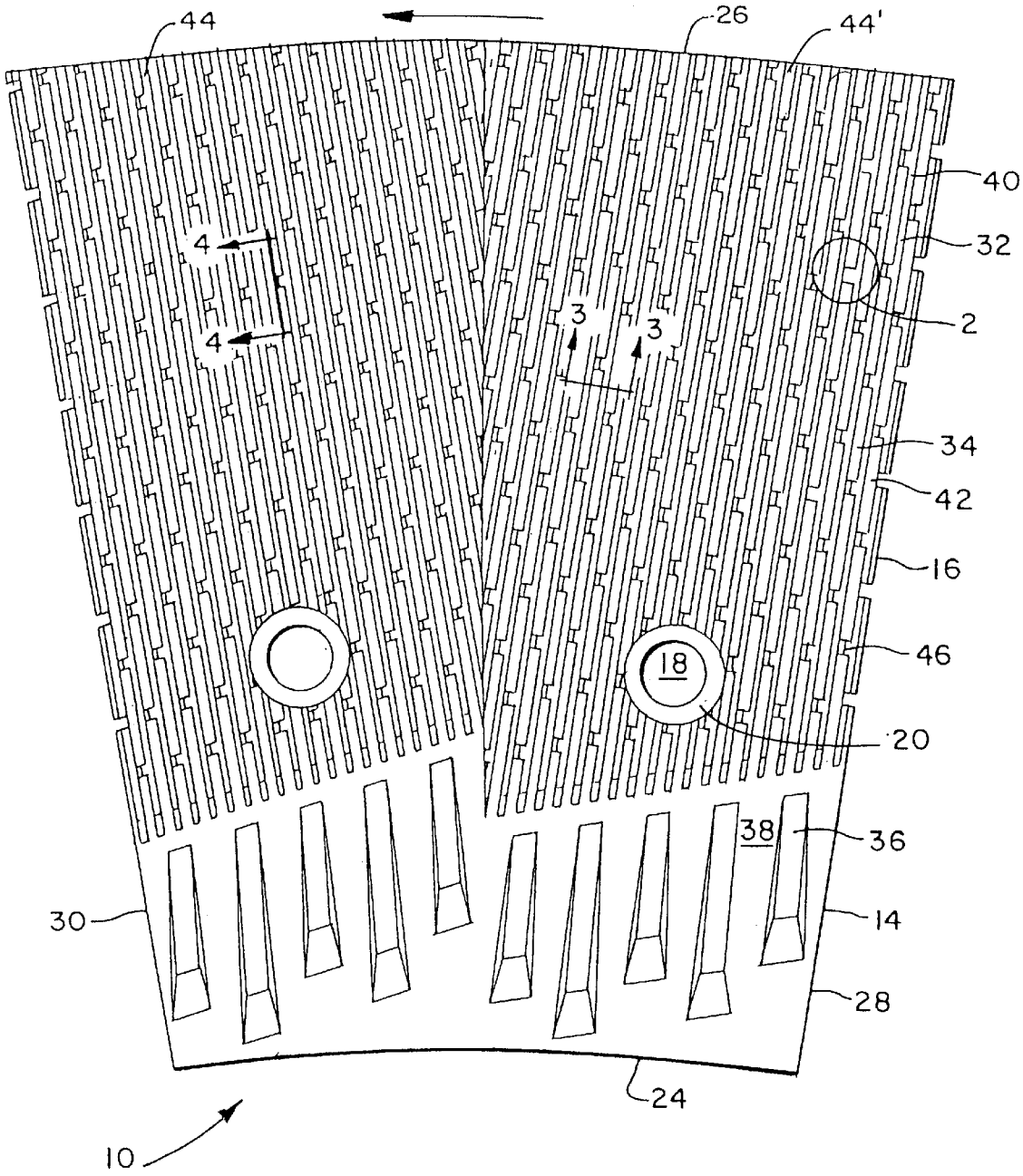
FIG. 1 is an elevation view of a refiner plate segment having a steam management system in accordance with the invention.

With reference to FIG. 1, each refiner plate segment 10 has an inner edge 24 near the center of the disc, an outer edge 26 near the periphery of the disc, and trailing and leading side edges 28, 30 which abut the leading and trailing side edges of adjacent refiner plate segments, respectively. The remainder of this description will refer to a single plate segment 10, but it should be understood that all the segments 10 which define the annular plate, are preferably substantially similar. The plate segment 10 has, on its face, at least one, and preferably two or three, distinct patterns of bars 32 and grooves 34 between the bars, whereby material to be refined can flow in the grooves 34 in the general direction from the inner edge 24 to the outer edge 26 of the plate segment 10. The bars 32 and grooves 34 extend substantially radially, i.e., radially, or parallel to a radius of the disc 12, or obliquely at an acute angle to such a radius.

A first or inlet zone 14 has a multiplicity of bars 36 and grooves 38 between adjacent bars 36, all of which extend substantially in the radial direction. This pattern is especially adapted for receiving wood chips, wood pulp, or the like and performing an initial refining operation thereon to reduce the size of the material and funnel it radially outward into a second, refining zone 16. The refining zone 16 has a multiplicity of bars 40 and grooves 42 between adjacent bars 40, which also extend in parallel, substantially radially. A third, outer zone may be provided between the refining zone 16 and the outer edge 26 of the plate. As shown in FIG. 1, each zone 14, 16 may comprise a plurality of fields 44, 44', where each field 44, 44' has a uniform pattern. In the embodiment shown in FIG. 1, the segment 10 has two fields 44, 44' in each zone 14, 16. The patterns promote the flow of steam radially outward to the outer edge of the disc and radially inward to the inner edge of the disc for evacuation while retarding the flow of material to ensure that the material is fully refined.

Since the disc 12 and plate rotate, the partially refined material is directed, as a result of centrifugal force, radially outward. Substantial quantities of steam are also generated in the refining zone 16 producing a steam flow with high radial velocity. Especially with relatively large discs, the centrifugal forces acting on the steam and partially refined chips increase dramatically as the material moves farther and farther radially outward. Although it is highly desirable that the steam be quickly exhausted from the refining region, it is essential that the partially refined fibers not be prematurely exhausted along with the steam. This condition is influenced by the radial pressure profile along the disc face due to steam generated by the refining at high consistency. Since the pressure peak is between the inner and outer edges 24, 26 of the plate, the steam flows forward (radially outward) from the outer side of the pressure peak and backward (radially inward) inside the pressure peak, against the material feed.

With reference to FIGS. 1 to 4, the refining zone 16 of a first embodiment of refiner plate segment 10 includes a plurality of partial dams 46 disposed in each of the grooves 42. Each dam 46 includes a full height portion 48 having a top surface 50 which is substantially co-planar with the top grinding surface 52 of the bars 40 and a partial height portion 54 having a top surface 56 disposed intermediate the top surface 52 of the bars 40 and the base 58 of the grooves 42. The full height portion 48 extends from the leading surface 60 of an adjacent trailing bar 62 to a point P intermediate the leading edge 64 of the trailing bar 62 and the trailing edge 66 of an adjacent leading bar 68. The partial height portion 54 extends from point P to the trailing face 70 of the leading bar 68. The relative width of the full height portion 48 and the partial height portion 54, the height of the partial height portion 54, and the shape of the partial dam 46 are dependent on the characteristics of the material to be refined and the degree of refining that is desired. For example, point P may be substantially mid way between the leading edge 64 of the trailing bar 62 and the trailing edge 66 of the leading bar 68 and the partial height portion 54 may extend substantially half way up the height of the groove 42, as shown in FIG. 3.

Figure 4:
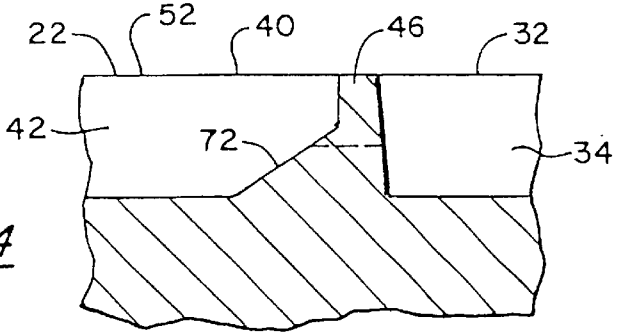
FIG. 4 is an enlarged section view along line 4—4 of FIG. 1.

The fibers or material in the groove 42 has a tendency to travel along the leading surface or face 60 of the trailing bar 62. Therefore, the full height portion 48 is positioned adjacent the leading face 60 of the trailing bar 62 to block the flow of material through the grooves 42 and to force such material up into the gap between the opposed refiner plates for further refining. As shown in FIG. 4, the dam 46 may have a radially extending ramp face 72 to guide the material out of the groove 42 and into the gap. The steam flowing through the passage 74 provided by the partial height portion 54 adjacent the trailing face 70 of the leading bar 68 carries very little material. Therefore, the amount of material that bypasses each partial dam 46 is very small.

Figure 5:
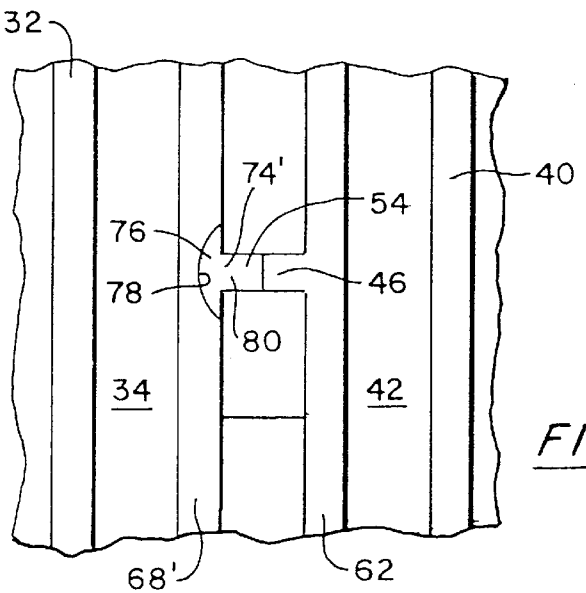
FIG. 5 is an enlarged elevation view of an alternate embodiment of the surface dam and bar of FIG. 3.
Figure 2:
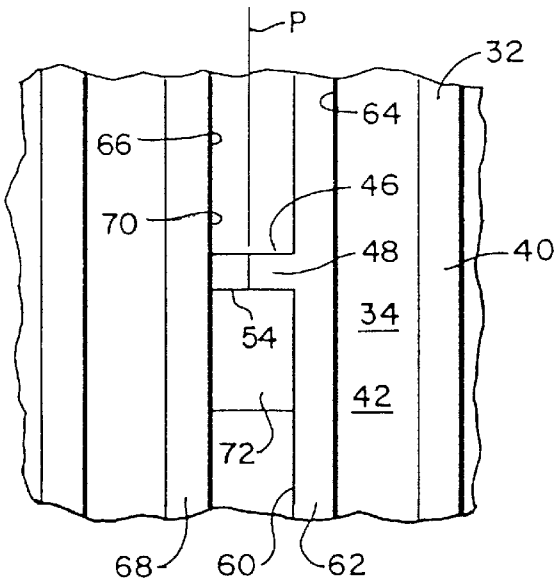
FIG. 2 is an enlarged elevation view of Area 2 of FIG. 1

With reference to FIG. 5, a trailing portion of each leading bar 68' may also be removed to form a cavity 76 which extends the cross-sectional area of the passage 74' defined by the partial height portion 54 of the dam 46. Preferably, the cavity 76 forms an arcuate-shape trailing face segment 78 adjacent the partial dam 46. Such a shape minimizes the turbulence on the inboard side of the partial dam 46 which could cause additional material to be entrained in the steam that passes through the flow passage 74'. Similarly, the bottom surface 80 of the cavity 76 is substantially co-planar with the top 56 of the partial height portion 54 to provide a relatively smooth surface that minimizes turbulence. The additional flow area provides for increased steam flow with little or no additional bypass flow of material.

Figure 6:
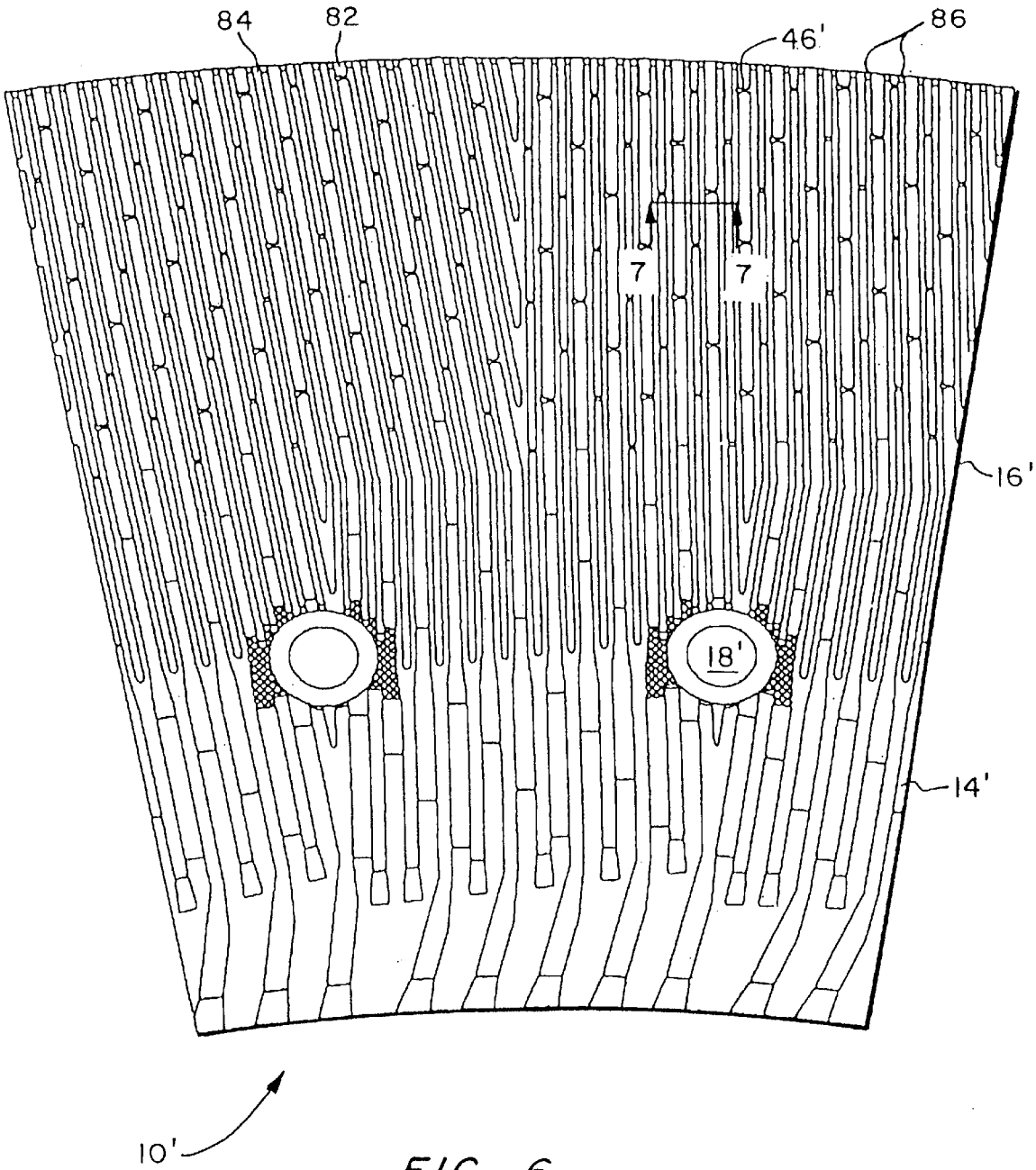
FIG. 6 is an elevation view of an alternate embodiment of the refiner plate segment of FIG. 1.
Figure 7:
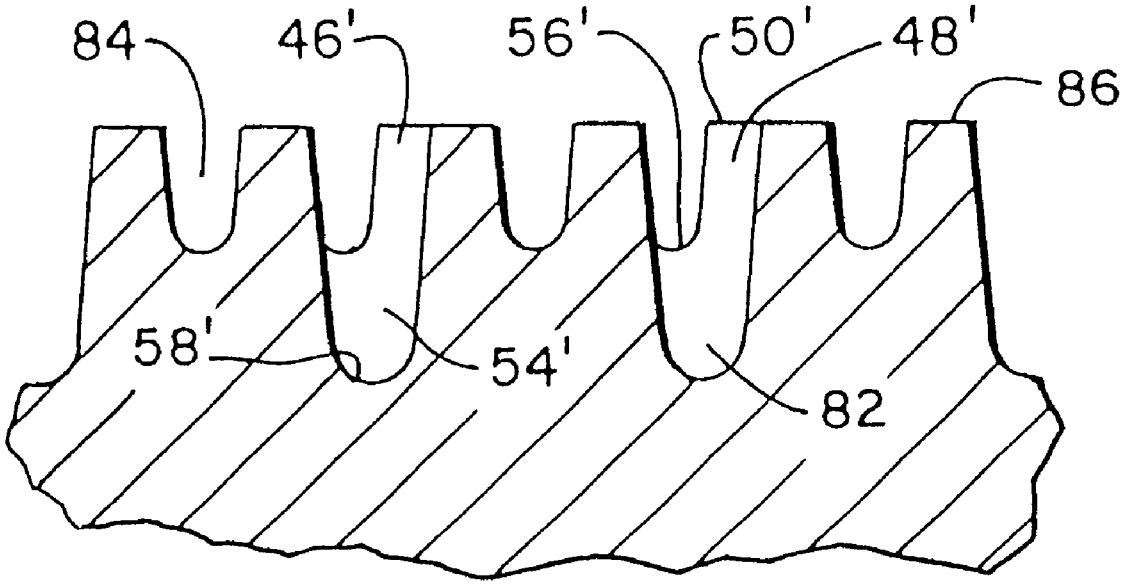
FIG. 7 is an enlarged section view along line 7—7 of FIG. 6.

U.S. patent application Ser. No. 08/886,310, filed Jul. 1, 1997, assigned to the assignee of the subject invention and hereby incorporated by reference, discloses a refiner plate having a variable pitch. One or more fields in the refining zone of such a refiner plate may have a combination of wide, deep grooves 82 and shallow, narrow mini-grooves 84. The wider and deeper grooves 82 provide a greater cross-sectional area for the flow of steam. The blades 86 created by the mini-grooves 84 define additional grinding surfaces and cause additional pulsations during refining operations, increasing the grinding efficacy of the refiner disc. With reference to FIGS. 6 and 7, a variable pitch refiner may also include partial dams 46' in accordance with the subject invention. The mini-grooves 84 do not account for a significant portion of the steam flow. Therefore, the partial dams 46' would be located only in the wide grooves 82. Each dam 46' includes a full height portion 48' having a top surface 50' which is substantially co-planar with the top grinding surface 52' of the blades 86 and a partial height portion 54' having a top surface 56' disposed intermediate the top surface 52' of the blades 86 and the base 58' of the wide grooves 82.

While preferred embodiments have been shown and described, various modifications and substitutions may be made thereto without departing from the spirit and scope of the invention. For example, the present invention may also advantageously implemented on a three zone segment. Accordingly, it is to be understood that the present invention has been described by way of illustration and not limitation.

What is claimed is:

1. A refiner plate segment for refining lignocellulosic material, comprising a refining zone having:

a plurality of substantially radially disposed bars, each of said bars having a top surface, a leading surface and a trailing surface, said plurality of bars defining a plurality of bar pairs comprising a leading bar and a trailing bar;

a plurality of grooves alternating with said bars, each of said grooves defining a base;

at least one dam extending laterally across a said groove intermediate said leading bar and said trailing bar of at least one bar pair, said dam comprising a first portion extending from said trailing surface of said leading bar and a second portion extending from said leading surface of said trailing bar, said first and second portions of said dam each having a top surface, wherein said top surface of said second portion is disposed substantially co-planar with said top surface of said trailing bar and said top surface of said first portion is disposed intermediate said top surface of said leading bar and said base of said groove.

2. The refiner segment of claim 1 wherein at least one of said dams is disposed in each of said grooves.

3. The refiner segment of claim 2 wherein a plurality of said dams are disposed in each of said grooves.

4. The refiner segment of claim 1 wherein said trailing surface and said top surface of said leading bar define a cavity disposed adjacent said first portion of said dam.

5. The refiner segment of claim 4 wherein said trailing surface of said leading bar comprises an arcuate-shaped segment forming said cavity.

6. The refiner segment of claim 4 wherein said cavity has a bottom surface which is substantially co-planar with the top surface of said first portion of said dam.

7. A refiner having relatively rotating opposed discs defining a refining gap, each of said discs carrying plates formed by a plurality of plate segments for refining lignocellulosic material wherein each plate segment comprises a plurality of substantially radially disposed bars, a plurality of grooves alternating with said bars, and a plurality of dams extending laterally across said grooves, said bars each having a top surface and defining a plurality of bar pairs comprising a leading bar and a trailing bar, said grooves each having a base, said dams each comprising a first portion disposed adjacent said leading bar and a second portion disposed adjacent said trailing bar, said first and second portions of said dam each having a top surface, wherein said top surface of said second portion is disposed substantially co-planar with said top surface of said trailing bar and said top surface of said first portion is disposed intermediate said top surface of said leading bar and said base of said groove.

8. The refiner segment of claim 7 wherein each of said bars further having leading and trailing faces, said first portion of said dam extending from said trailing face of said leading bar to a point intermediate said leading and trailing bars and said second portion extending from said point to said leading face of said trailing bar.

9. The refiner of claim 7 wherein each of said dams has a radially extending sloped leading face for directing the material into said refining gap.

10. The refiner segment of claim 7 wherein said leading bar defines a cavity disposed adjacent said second portion of said dam.

11. The refiner segment of claim 10 wherein each of said bars further has a trailing face, said trailing face of said leading bar comprises an arcuate-shaped segment forming said cavity.

12. The refiner segment of claim 11 wherein said cavity has a bottom surface which is substantially co-planar with the top surface of said first portion of said dam.

13. The refiner segment of claim 7 wherein said top surface of a plurality of said bars each define at least one substantially radially disposed mini-groove, none of said dams being disposed in a said mini-groove.

14. A method for directing the flow of feed material and steam, generated between a pair of relatively rotating opposed refining discs defining a refining gap, during refining of a lignocellulosic material in a refiner, each of the discs having radially inner and outer edges and a face pattern including a refining zone having a plurality of substantially radially disposed bars, a plurality of grooves alternating with said bars, and a plurality of dams extending laterally across said grooves, said bars each having an upper grinding surface and defining a plurality of bar pairs comprising a leading bar and a trailing bar, said grooves each having a base, said dams each comprising a first portion disposed adjacent said leading bar and a second portion disposed adjacent said trailing bar, said first and second portions of said dam each having an upper surface, said second portion of said dam having a sloped leading face, said upper surface of said second portion being disposed substantially co-planar with said upper surface of said trailing bar and said upper surface of said first portion being disposed intermediate said upper surface of said leading bar and said base of said groove, wherein said upper surface of said first portion, said second portion and said leading bar define a steam flow passage, the method comprising the steps of 1) directing the feed material up the sloped leading face of the second portion of said dam to the refining gap with a centrifugal force generated by rotating at least one of the refining discs for comminution on the grinding surface of the bar; and 2) directing the steam through the grooves and the steam flow passages to the outer edge of the discs with the centrifugal force and thereby removing the steam from between the discs.

* * * * *